US008170693B2

(12) United States Patent
Mahew

(10) Patent No.: US 8,170,693 B2
(45) Date of Patent: May 1, 2012

(54) STAGE COMMAND AUTOSTOP

(75) Inventor: Rusty Mahew, Carrollton, TX (US)

(73) Assignee: Production Resource Group, LLC, New Windsor, NY (US)

( * ) Notice: Subject to any disclaimer, the term of this patent is extended or adjusted under 35 U.S.C. 154(b) by 256 days.

(21) Appl. No.: 11/856,622

(22) Filed: Sep. 17, 2007

(65) Prior Publication Data

US 2008/0091280 A1 Apr. 17, 2008

Related U.S. Application Data

(60) Provisional application No. 60/844,732, filed on Sep. 15, 2006.

(51) Int. Cl.
*H02B 1/24* (2006.01)
*G05B 11/01* (2006.01)
*G06F 19/00* (2011.01)

(52) U.S. Cl. ..... 700/12; 700/21; 700/245

(58) Field of Classification Search ..... 700/11–14, 700/17–21, 23, 26, 27, 245–249; 307/31, 307/36–41, 112, 113, 115, 116, 125, 126, 307/130, 131; 714/100, 1, 2, 24
See application file for complete search history.

(56) References Cited

U.S. PATENT DOCUMENTS 3,659,208 A * 4/1972 Fussell ..... 327/58
3,943,534 A * 3/1976 Arai ..... 396/391
4,648,027 A * 3/1987 Toyooka et al. ..... 700/79
5,132,832 A * 7/1992 Matz et al. ..... 398/58
5,583,987 A * 12/1996 Kobayashi et al. ..... 714/13
5,644,461 A * 7/1997 Miller et al. ..... 361/56
5,652,521 A * 7/1997 Meyer ..... 324/551
5,841,257 A * 11/1998 Hashimoto et al. ..... 318/568.11
5,875,353 A * 2/1999 Whetsel ..... 710/38
5,993,039 A * 11/1999 Crill ..... 700/79
6,272,001 B1 * 8/2001 Futsuhara ..... 361/170
6,297,569 B1 * 10/2001 Bartels et al. ..... 307/140
6,370,438 B1 * 4/2002 Rocchia et al. ..... 700/79
6,463,529 B1 * 10/2002 Miller et al. ..... 713/2
6,570,272 B2 * 5/2003 Dickhoff ..... 307/113
6,570,355 B2 * 5/2003 Morita et al. ..... 318/563
6,734,581 B1 * 5/2004 Griffis ..... 307/125
6,822,346 B2 * 11/2004 Floro et al. ..... 307/66
6,992,458 B2 * 1/2006 Hashimoto et al. ..... 318/568.13
7,208,899 B2 * 4/2007 Hashimoto et al. ..... 318/563
7,339,774 B2 * 3/2008 Zdziech et al. ..... 361/93.1
7,340,311 B2 * 3/2008 Landis et al. ..... 700/17
7,348,690 B2 * 3/2008 Muldoon ..... 307/326
7,408,274 B2 * 8/2008 Sullivan et al. ..... 307/130
7,429,990 B2 * 9/2008 Congdon et al. ..... 345/520
7,478,232 B2 * 1/2009 Peterson et al. ..... 713/1
7,610,119 B2 * 10/2009 Abe et al. ..... 701/1

(Continued)

FOREIGN PATENT DOCUMENTS

JP 05173674 A * 7/1993

(Continued)

*Primary Examiner* — M. N. Von Buhr
(74) *Attorney, Agent, or Firm* — Law Office of Scott C. Harris, Inc.

(57) ABSTRACT

The present system teaches an autostop system for a stage control system in which some of all of the device implemented effects associated with a production may be automatically stopped when certain conditions exist. The conditions causing the effects to stop may be configurable by the show creator to prevent injury to the persons involved with the production and damage to the scenery and equipment.

4 Claims, 5 Drawing Sheets

U.S. PATENT DOCUMENTS

2003/0084277 A1* 5/2003 Przywara et al. ..... 713/1
2004/0153926 A1* 8/2004 Abdel-Hafez et al. ..... 714/726
2005/0057868 A1* 3/2005 Pullmann et al. ..... 361/62
2005/0197824 A1* 9/2005 Van Dalen ..... 703/28
2006/0138231 A1* 6/2006 Elberbaum ..... 235/439
2007/0191966 A1* 8/2007 Fisher et al. ..... 700/1
2007/0241261 A1* 10/2007 Wendt ..... 250/221

FOREIGN PATENT DOCUMENTS

JP 2000010673 A * 1/2000
JP 2000013983 A * 1/2000
JP 2005341783 A * 12/2005

* cited by examiner

STAGE COMMAND AUTOSTOP

CROSS-REFERENCE TO RELATED APPLICATIONS

This application claims priority to U.S. Application 60/844,732, filed Sep. 15, 2006. The disclosure of the prior application is considered part of (and is incorporated by reference in) the disclosure of this application.

BACKGROUND

A stage show production or corporate event can include a number of different effects. The effects can include the automatic movement of stage actors and scenery, complex lighting schemes and other things. The show may call for the movement of large pieces of stage scenery and several show elements may be in motion at the same time. The movements required by the show may be complex, involving both horizontal and vertical movement. The safety of the show participants is critically important.

SUMMARY

The present system teaches an autostop system for a stage control system in which some or all of the device implemented effects associated with a production may be automatically stopped when certain conditions exist. The conditions causing the effects to stop may be configurable to prevent injury to the persons involved with the production and damage to the scenery and equipment.

DETAILED DESCRIPTION

The general structure and techniques, and more specific embodiments which can be used to effect different ways of carrying out the more general goals are described herein.

In one embodiment, show control station 105 is connected to a local area network (LAN) via connection 110. The LAN component of connection 110 may be provided via a Category-5 network cable, a wireless network or the like.

Figure 1:
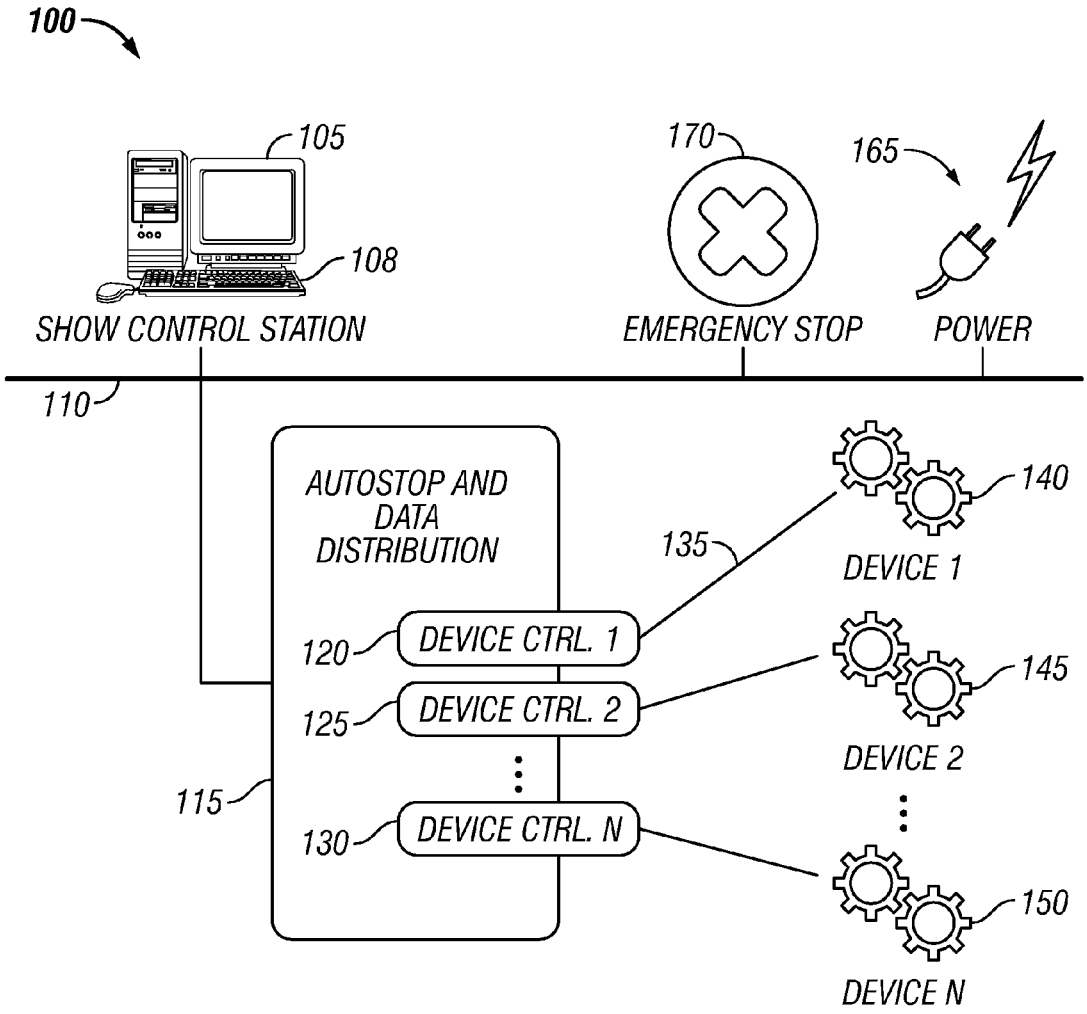
FIG. 1 shows a basic block diagram of a show control system according to an embodiment of the invention.

In the FIG. 1 embodiment, connection 110 further includes emergency stop signal 170. Emergency stop signal 170 is routed to each autostop and data distribution 115 in show control system 100 via connection 110. Emergency stop 170 may be asserted by pressing a button, flipping a switch or other. Emergency stop signal 170 may be propagated via connection 110 using any data communication technique: a constant voltage line, a twisted pair line, Ethernet or other.

In one embodiment, connection 110 further includes power source 165. Power 165 is routed to each autostop and data distribution 115 via any cable capable of transmitting sufficient power to power devices 140-150 and autostop and data distribution 115.

Figure 2:
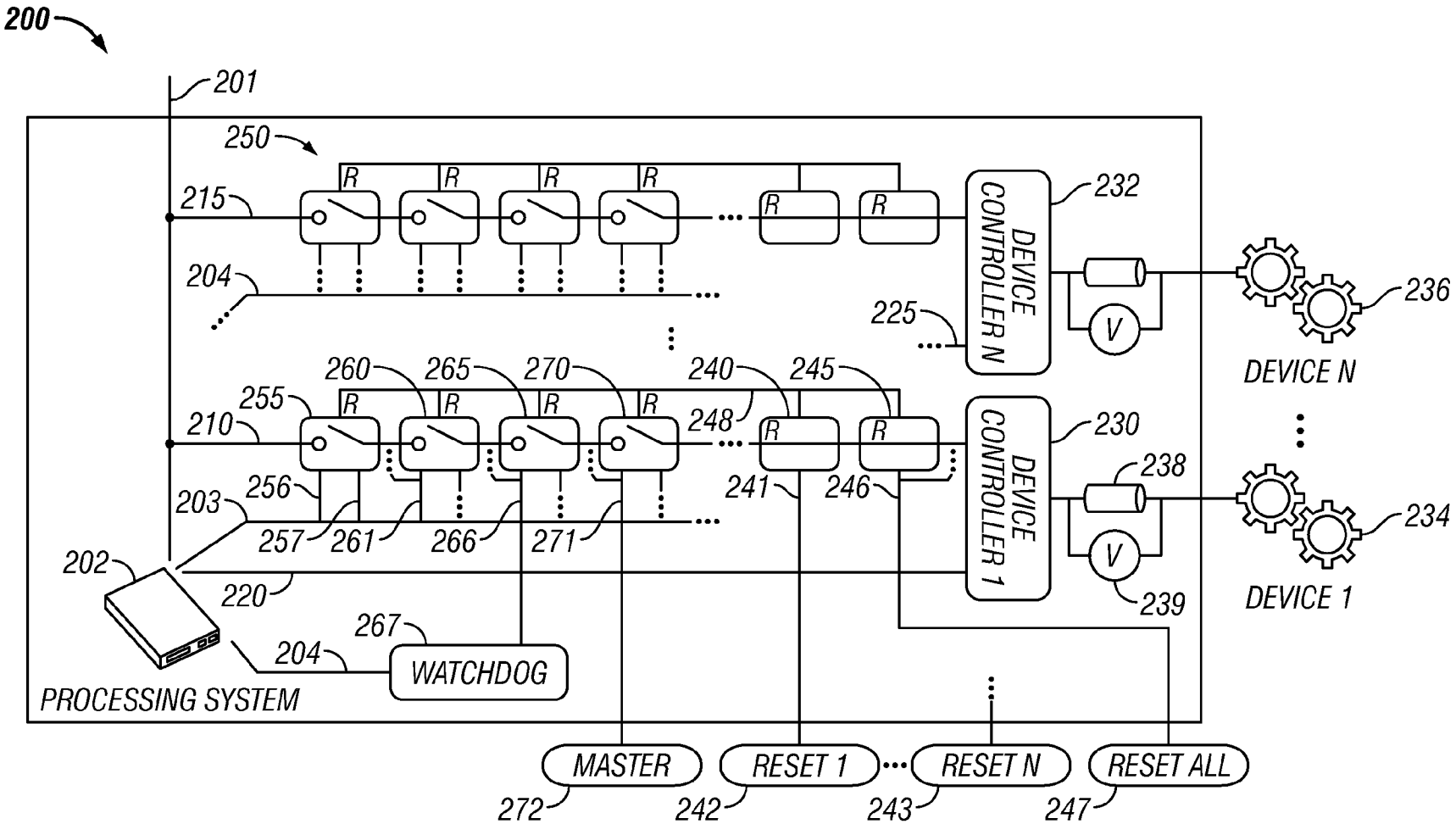
FIG. 2 shows a block diagram of an autostop and data distribution component according to an embodiment of the invention.

FIG. 2 shows a block diagram of one embodiment of an autostop and data distribution component. Autostop and data distribution 200 may be used to control and power one or more devices 234-236.

In one embodiment, autostop and data distribution 200 receives input 201 which may include a LAN connection, a power input, and an emergency stop signal. Input 201 may include master autostop signal 272, however, in the FIG. 2 embodiment, master stop 272 is shown as a separate input.

In one embodiment, at least a portion of the power component of input 201 is routed to devices 234-236. Each device 234-236 is connected to power by power connection 210-215. For example, device 1 234 receives power via power connection 210 and device n 236 receives power via power connection 215. The power connection of each device 234-236 passes through one or more relays 250, 255, 260, 265 and 270. A relay is any device capable of opening and closing an electrical connection based on an input signal.

In the FIG. 2 embodiment, relays 250, 255, 260, 265 and 270 provide status information to processing system 202. The status information may indicate the relay's position: i.e. "open" or "closed." For example, connection 257 may be used to provide the status information of relay 255 to processing system 202 via communication bus 203. Each of the other relays 250, 260, 265 and 270 may include a similar connection. These connections have been omitted from FIG. 2 to reduce its complexity.

The LAN connection of input 201 is connected to processing system 202. Processing system 202 may include one or more central processing units (CPU) coupled to one or more random access memory (RAM) devices. Processing system 202 may further include one or more persistent storage locations such as a disc drive, flash memory, or the like.

In one embodiment, processing system 202 is capable of receiving and transmitting data via network connection 201. Processing system 202 is in communication with each device controller 230-232 via connections 220-225. Processing system 202 may be configured to receive commands for devices 230-232 via network connection 205.

In the FIG. 2 embodiment, the network connection and protocol provided via connection 201 may be different than the network connection and protocol used by processing system 202 to communicate with device controllers 230-232. For example, network connection 201 may be a LAN connection provided via Category-5 cable running Transmission Control Protocol (TCP) whereas connections 210 and 215 may be Controller Area Network (CAN) connections provided over RS-485 cable. In this embodiment, processing system 202 is configured to read and transmit data via both connections using both protocols.

Upon receipt of a command directed to a device 234-236 via network connection 201, processing system 202 processes the command and transmits one or more corresponding commands over the appropriate communications connection 220-225 to device controller 230-232. For example, if processing system 202 received a command over LAN connection 201 directed to device 1 234, processing system 202 would transmit one or more corresponding commands to device controller 1 230 via communications connection 210.

Device controllers 230-232 receive commands from the processing system 202 via communication connections 220-225. Responsive to these commands, device controllers 230-232 may cause devices 234-236 to operate corresponding to the received commands. The nature of such operation may depend on the device type as discussed below.

Devices 234-236 may be any one of a variety of device types including, but not limited to, a winch, lighting system, servo actuator, movement rack, or any other device adapted to receiving control input from a device controller 230-232. The device controller 230-232 associated with each device is configured to interact with a particular type of device 234-236. For example, if device 234 were a winch, device controller 230 may be configured to cause the winch to wind or unwind a certain number of rotations. Device controller 230 may also be configured to read from the winch 234 how much cable is released responsive to the turning, allowing controller 230 to command the winch to wind or unwind a certain length of cable. Device controller 230 may be configured to store or report the amount of cable currently unwound from winch 234, providing the position of an object attached to the winch 234.

In one embodiment, device controllers 230-232 may transmit status data to processing system 202 via connections 220-225. Such status data may include, the temperature of the device 234-236, the power consumption of the device 235-236, the temperature of device controller 230-232, the status of the self-resetting fuse 238 (discussed below), the position of the device or an object attached to the device, the velocity of the device, the acceleration of the device, or any other status information available to device controller 230-232.

In the embodiment of FIG. 2, the power connection 210 to device 234 is routed through self resetting fuse 238. Self resetting fuse 238 may open when it is overloaded, breaking the circuit, then automatically close to restore the circuit when conditions change. For example, a thermoplastic self-resetting fuse opens when it is overloaded (becomes too hot) and then automatically closes once its temperature returns to its normal operating range.

Device controller 230-232 may determine whether self-resetting fuse 238 is open by monitoring voltage detector 239. When self-resetting fuse 238 is closed, voltage detector 239 will not register a significant voltage differential. When self-resetting fuse 238 is open, voltage detector 239 will register a voltage differential. When device controller 230-232 detects that self-resetting fuse is open, it may store the information in a counter and/or transmit the information to processing system 202 via communications connection 220-225.

In one embodiment, relays 250, 255, 260, 265 and 270 are connected to control the power connection 210-215 to devices 234-236. For example, relays 255, 260, 265, and 270 are connected serially so than if any one is in the "open" or "off" position, the power connection 210 to device 234 is broken.

In one embodiment there are 1+n or 2*n reset devices 240, 245 where "n" is the number of device controllers 230-232 in autostop and data distribution 200. The first set of reset devices 245, reset the state of all relays for each of the relays 250, 255, 260, 265, 270 to the "on" position. This is a global reset 245. The global reset function may be embodied in a single reset device 245 or may include a separate reset device 245 attached to each device in autostop and data distribution 200, the separate reset devices 245 having a common input. The second reset device 240 is a device specific reset that resets only the relays corresponding to a particular device 234-236. For example, reset 1 242 connected to reset device 240 is configured to reset only relays 255, 260, 265, and 270 corresponding to power connection 210 of device 1 234. The reset devices 240, 245 are manually activated via inputs 242, 243, 247.

In the FIG. 2 embodiment, relay 255 is configured to be set into its "off" position responsive to a signal from processing system 202 via connections 203 and 256. If relay 255 is in the "off" position, power is removed from device 1 234. No other devices 236 are affected. Processing system 202 may cause relay 255 to switch to the "off" position responsive to a "device autostop" command received via network connection 201.

In one embodiment, relay 260 is configured to be set into its "off" position by processing system 202 via connections 203 and 261. If relay 260 is in the "off" position, power is removed from all of the devices 234-236. This may be done by placing a single relay 260 in series with each power connection 210-215, or, as shown in FIG. 2, by placing a separate relay 260 in series with each power connection 210-215, with each relay 260 sharing a common control input 261. Processing system 202 may cause relay 260 to switch to the "off" position responsive to a "global autostop" command received via network connection 201.

In one embodiment, relay 265 is set into the "off" position by watchdog device 267 via connection 266. If relay 265 is in the "off" position, power is removed from all devices 234-236. This may be achieved with a single relay 265 in series with each power connection 210-215, or via separate relays 265 attached to each power connection 210-215 as shown in FIG. 2.

Watchdog 267 monitors the operation of processing system 202. Generally, watchdog devices are used to detect infinite loops or other failures in a processing system. In one embodiment watchdog 267 may be a watchdog timer device which restarts an internal clock each time a transition on input 204 occurs. If the clock timer reaches a certain point (indicating inactivity on input 204), watchdog 267 may cause relay 265 to go into the "off" position.

Watchdog input 204 may be derived from any processing system 202 output. Some of the most commonly used outputs include data, addressing and, I/O signals. Alternatively, signal 204 may be produced as part of the software running on processing system 202. In the event of a software or hardware fault, the code producing signal 204 will fail, alerting watchdog 267.

In one embodiment relay 270 is set to the "off" position by master input 272. Master input 272 may be used in conjunction with an "emergency stop" button shown in FIG. 1 element 170. As a result of relay 270 being in the "off" position, power is removed from all devices 234-236. Again, this may be achieved with a single relay 270 in series with each power connection 210-215 or via separate relays 270 having a common control input.

Figure 3:
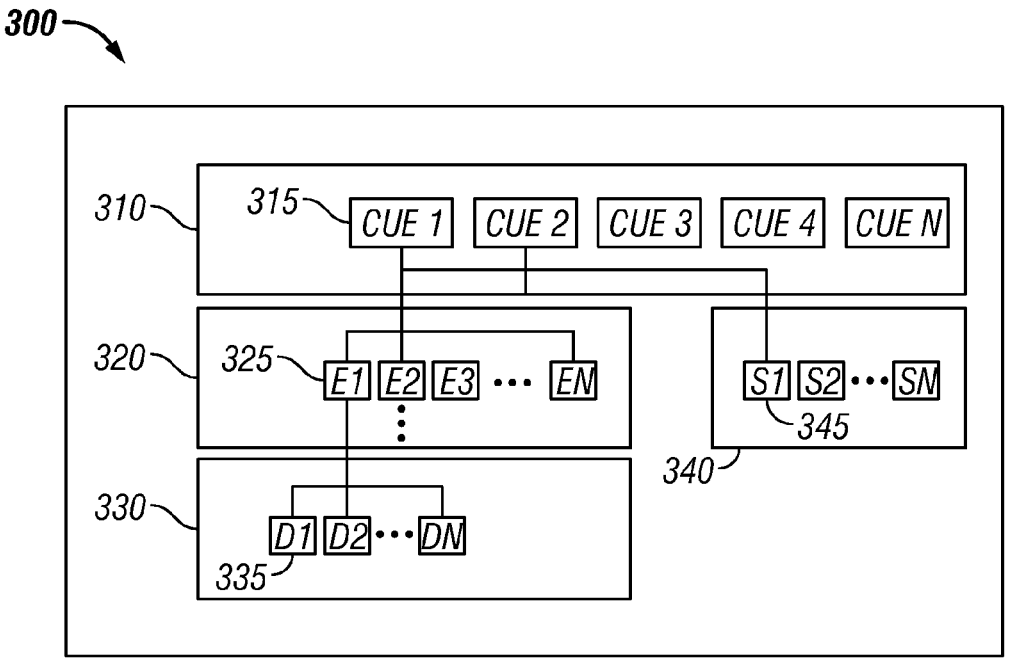
FIG. 3 shows a basic data structure of a show profile according to an embodiment of the invention.

FIG. 3 shows a basic data structure corresponding to show profile 300 according to one embodiment of the invention. Show profile 300 contains an ordered collection of cues 310. The cues are arranged by cue numbers that define the order the cues are executed. For example, a first cue may raise an actor into the air while a second cue lowers the actor back to the ground and so on. Show profile 300 with its corresponding cues 310 may define all of the cues 315 and effects 325 used in a show or event.

Each cue 315 may include one or more effects 325 in an effect profile 320. The embodiment of FIG. 3 shows cue 315 having effect profile 320. The effect profile 320 includes a series of effects arranged in the order of ascending effect number to be performed during cue 315.

Each effect 325 within effect profile 320 may include a device profile 330. Device profile 330 is used to define and configure the devices 335 used to create an effect 325. In the embodiment of FIG. 3, effect 325 has device profile 330 which contains a list of devices 335 used to create effect 325.

In the embodiment of FIG. 3, cue 315 references style-sheet 340. Style-sheet 340 is applied to effect profile 320 to modify one or more effect 325 and corresponding device profile 330. For example, effect 325 may define a complex sequence in which an actor is moved through the stage area on a path defined by a 3D spline, and, during the movement, a lighting system may be used to spotlight the actor. Effect 325 may be defined generically with a speed of 2 ft./second and plain white lighting. The application of style sheet 345 from style sheet repository 340 may modify profile 320 for use in a particular scene. For instance, if cue 1 were used in a fight scene, the application of style-sheet 340 may cause the movement speed to increase to 3 ft./second and use red rather than white lighting. Conversely, if the effect were to be adapted to a more somber scene, style-sheet 345 may cause the movement speed to decrease to 1 ft./second and employ muted blue lighting. Thus, the use of style-sheets 340 allows complex effect profiles to be re-used in different cues, reducing the complexity of the system and increasing operator efficiency.

Figure 4:
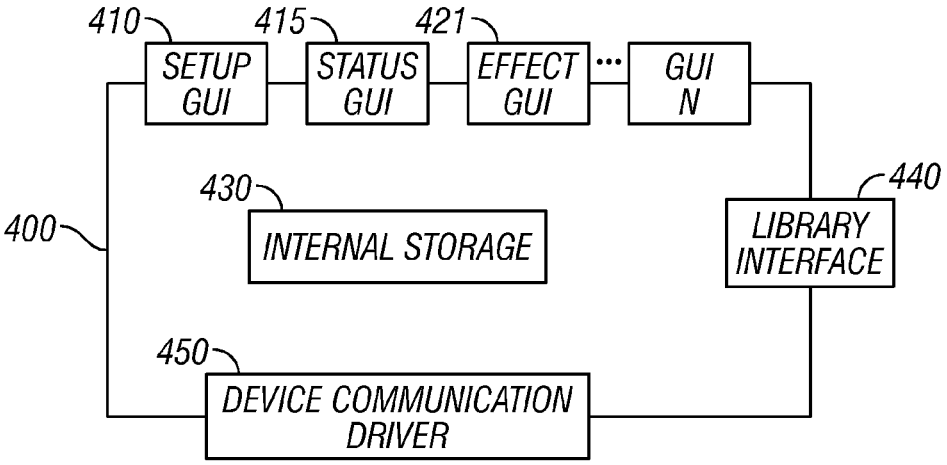
FIG. 4 shows a simplified diagram a device management module library according to an embodiment of the invention.

FIG. 4 shows a basic block diagram of a device management module library (DMML) 400. DMML 400 allows the applications comprising the show control system of FIG. 5 to initialize, operate, and maintain a particular type of device. Each device type may have a corresponding DMML 400. DMML 400 may be implemented as a dynamically loadable library (DLL). A DLL is machine readable code that may be loaded and used by a software application at run-time. Such libraries may be implemented using different technologies, including: dynamic link libraries (DLL), Unix shared libraries (SO), Java™ class files, or the like.

DMML 400 implements library interface 440 to allow the other applications and components of the show control system software to interact with it. Library interface 400 methods may include: providing information about DMML 400 such as its type and version, getting and setting device parameters, reading the current status and position of the device, providing access to DMML GUI components 410-420 and the like. Configuration information received through library interface 440 may be stored in DMML internal storage 430.

In the embodiment of FIG. 4, DMML 400 is adapted to provide control commands to a specific type of device via device communication driver 450. Device communication driver 450 communicates using a message format and communications protocol appropriate for the device (i.e. winch or lighting system) and autostop and data distribution.

In one embodiment, device management module library 400 further includes GUI components 410-420 which may be invoked through library interface 440. Data and commands supplied through GUI components 410-420 may be stored in internal storage 430 and/or propagated to the device through device communication driver 450. The GUIs may include: a device set-up GUI 410 to initialize the device and change its set-up parameters, a device status GUI 415 to display the current status and position of the device, and a device effect GUI 420 to view and change a motion profile of the device.

Figure 5:
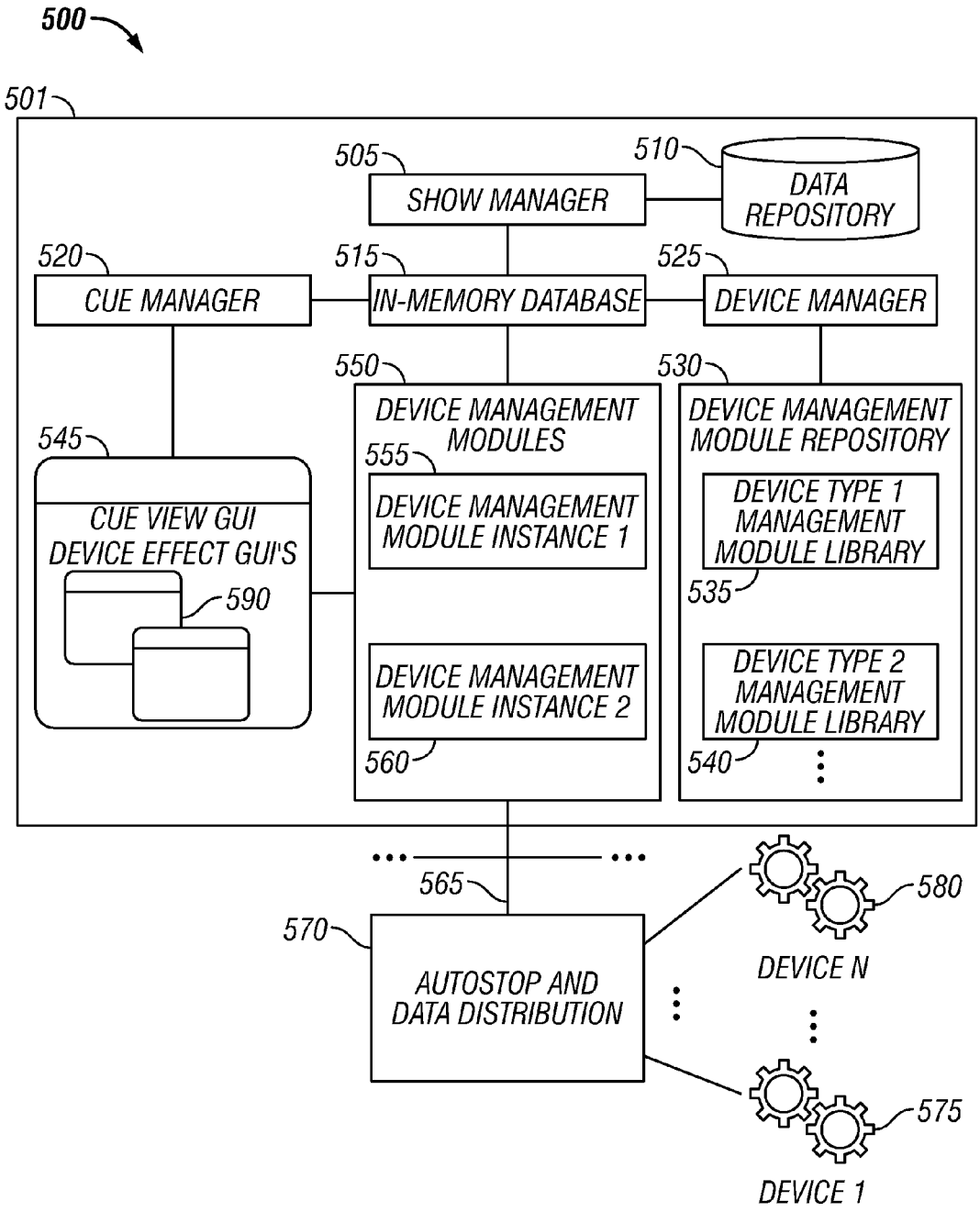
FIG. 5 shows a diagram of the application software components of the show control system according to one embodiment of the invention.

FIG. 5 is a block diagram of the software application components of stage command system 500. In the FIG. 5 embodiment, a user may invoke the applications comprising stage command system 500 via an operating system of computing system 501, causing show manager 505 to be loaded.

In one embodiment, show manager 505 may present a user interface allowing the user to either load an existing show profile from data repository 510 or create a new show profile. The show profile may consist of serialized data or database entries representing a data structure discussed in conjunction with FIG. 3. Data repository 510 may store data in a variety of ways, including but not limited to: a database storage system such as Microsoft Access™ or Oracle™, a filesystem such as Filesystem Hierarchy Standard (HFS) or New Technology File System (NTFS), or any other technology capable of providing for the storage and retrieval of information.

After obtaining a show profile, an in-memory database 515 representation of the show profile is created. Changes to the show profile in in-memory database 515 may be stored via data repository 510.

In the FIG. 5 embodiment, device management module repository 530 contains information about each of the DMML 535-540 available to show control system 500. DMML 535-540 are contained in device management module repository 530. Device manager 525 may interact with device management module repository 530 to display the available DMML 535-540 and to instantiate DMML as required by the applications and components of show control system 500.

In the FIG. 5 embodiment, show control manager 500 includes cue manager 520. Cue manager 520 determines the execution of cues and effects of the show profile within in-memory database 515. Cue manager 520 may be invoked by show manager 505. Upon loading, cue manager 520 reads the show profile stored in in-memory database 515. Cue manager 520 interacts with device manager 525 to load each DMML 535-540 referenced in the show profile. Cue manager 520 stores the DMML instances 555-560 in device management module container 550.

Cue manager 520 may load cue view GUI 545 to display the cue list of in-memory database 515. Cue view GUI 545 loads and displays the device effect GUI 590 associated with each device management module referenced by in-memory database 515.

A cue may be selected on view GUI 545. The selection causes cue view GUI 545 to display the effect GUI associated the effect profiles defined in the selected cue. Cue manager 520 may load the current and previous cue data from in-memory database 515 to determine whether the effect profile of the selected cue may be executed. For example, a device may have a maximum velocity or fixed range of movement and the position of the devices before and after the selected cue may require the device to act outside of its specification (i.e. the device would have to exceed its maximum velocity to get into position for the next cue, etc.) If cue manager 520 determines that the motion profile of the selected cue cannot be performed, cue manager 520 sends this information to the corresponding DMML instance 555-560. The effect GUI associated with the DMML instance 590 will display the problem to the user via cue view GUI 545.

In one embodiment, cue manager 520 allows the user to define "start conditions" under which an effect may begin execution. A start condition may be time-based, such that the effect cannot begin until a certain time has elapsed from the start of the cue. A start condition may depend on the position of other effects, such that the effect may only execute when other effects are in a specified position. Alternatively, the start condition may be "forced true" so that the effect will always execute.

In one embodiment, cue manager 520 may allow the user to create one or more global interlock conditions which define when one or more devices should be stopped. A global interlock condition may utilize conventional programming features such as: conditional operations ("IF", "THEN", "ELSE", etc.), logical operators ("AND", "OR", etc.), mathematical operators (add, subtract, multiply, divide, etc.), and precedence operators such as brackets. A global interlock condition may access all of the cue effect devices and their attributes, including: position, acceleration, etc. Using these operators, a user may define a condition such as:

```
IF ((Effect1.position>30) AND ((Effect2.position<20)
    OR (Effect3.accel > 20))) THEN
    Global.autostop = 1
ENDIF
```

The proceeding condition will assert a global autostop if the position of effect 1 is greater than 30 while the position of effect 2 is less than 20 or the acceleration of effect 3 is greater than 20.

When a cue is played, cue manager 520 spawns threads for each of the effects that are out of position for the selected cue. The spawned threads evaluate the start condition for each effect as discussed above. If the start condition evaluates to true, the motion profile for the effect is sent to the appropriate device management module and the effect begins execution.

Cue manager 520 may assist the device manager module 555-560 in determining the commands to be sent to the device. For example, the effect profile may call for a device to follow a complex motion profile such as a 3D spline. In such a case, cue manager 520 may calculate the set-points the device is to follow and provide such to the DMML instance 555-560.

In the FIG. 5 embodiment, DMML instances 555-560 form the command structure to be sent via network connection 565. Autostop and data distribution 570 receives the commands, processes them, and transmits corresponding commands to effect devices 575-580.

While the cue is in play back mode, cue manager 520 is in communication with DMML instances 555-560 to determine the status of the devices. The status information for each device is displayed in the device status GUI and/or effect GUI 590 via cue view GUI 545. Information such as the position of the device, the device target position, the current device velocity, etc., may be displayed in this manner. During operation, this information is continuously updated by device management modules 555-560.

In one embodiment, cue manager 520 is in communication with autostop and distribution 570 in order to monitor its status. Autostop and data distribution 570 may provide status information about devices 575-580, including: the state of the self-resetting fuse, temperature, power consumption, the state of the relays, etc. Cue manager 520 may use such information to evaluate the global interlock conditions associated with the cue.

In one embodiment, cue manager 520 may evaluate the status information independently of the cue global interlock logic. For example, cue manager may assert an autostop in the event an unsafe condition is detected such as a high temperature in a device or failures in the self-resetting fuse. Similarly, other feedback parameters from autostop and data distribution 570 may be monitored such as excessive power consumption and/or tripped relays in other effect devices 575-580.

In one embodiment, a user may manually indicate that an autostop signal should be asserted via cue view GUI 545 or some other user interface of show control system 500. Cue view GUI 545 may provide a user interface with an autostop button such as "global-stop" or "autostop." If this button is selected, cue view GUI 545 indicates to cue manager 520 that an autostop condition should be asserted.

In one embodiment, if cue manager 520 determines that autostop should be asserted for one or more devices, an autostop signal is sent to the corresponding DMML instance 555-560. DMML instances 555-560 send an autostop command via network connection 565 to autostop and data distribution 570. The processing system of autostop and data distribution 570 then removes power from the device by setting the device or global autostop relay to "off" as described above.

In one embodiment, autostop and data distribution 570 may communicate the relay status to cue manager through device management modules 555-560. Device effect GUIs 590 may display their autostop status via cue view GUI 545. Additionally, cue manager 520 may indicate the reason autostop was asserted on the device 575-580. For example, if a device 575 was stopped because it failed to move to position X, the device effect GUI corresponding to the device may indicate such. Similarly, if autostop was asserted due to a global interlock condition involving one or more devices, cue manager 520 may provide information to the user via cue view GUI 520 describing how the global interlock condition may be de-asserted. For example, if a global interlock condition reciting "Effect1.position>30 AND Effect2.position<20" cue view GUI may indicate that if effect1 is moved to have a position of less than 30 or effect 2 is moved to have a position of more than 20, the autostop may be de-asserted. If the autostop signal was asserted due to excessive temperature and/or power consumption, cue view GUI 545 may so indicate and may update the user when the temperature and/or power level returns to an acceptable level. Similarly, if the autostop signal was asserted via an emergency stop system such as emergency stop 170 of FIG. 1, cue view GUI 545 may indicate that the source of the autostop was external to show control system 500.

In one embodiment, a relay in autostop and data distribution 570 in the "off" position may not be switched into the "on" position via the show control system 500. The relays of autostop and data distribution 570 must be manually reset to their "on" position at autostop and data distribution 570. This is a fail-safe condition ensuring that a fault in show control system 500 or network connection 565 may not re-start a device 575-580 while it is in an unsafe position.

Figure 6:
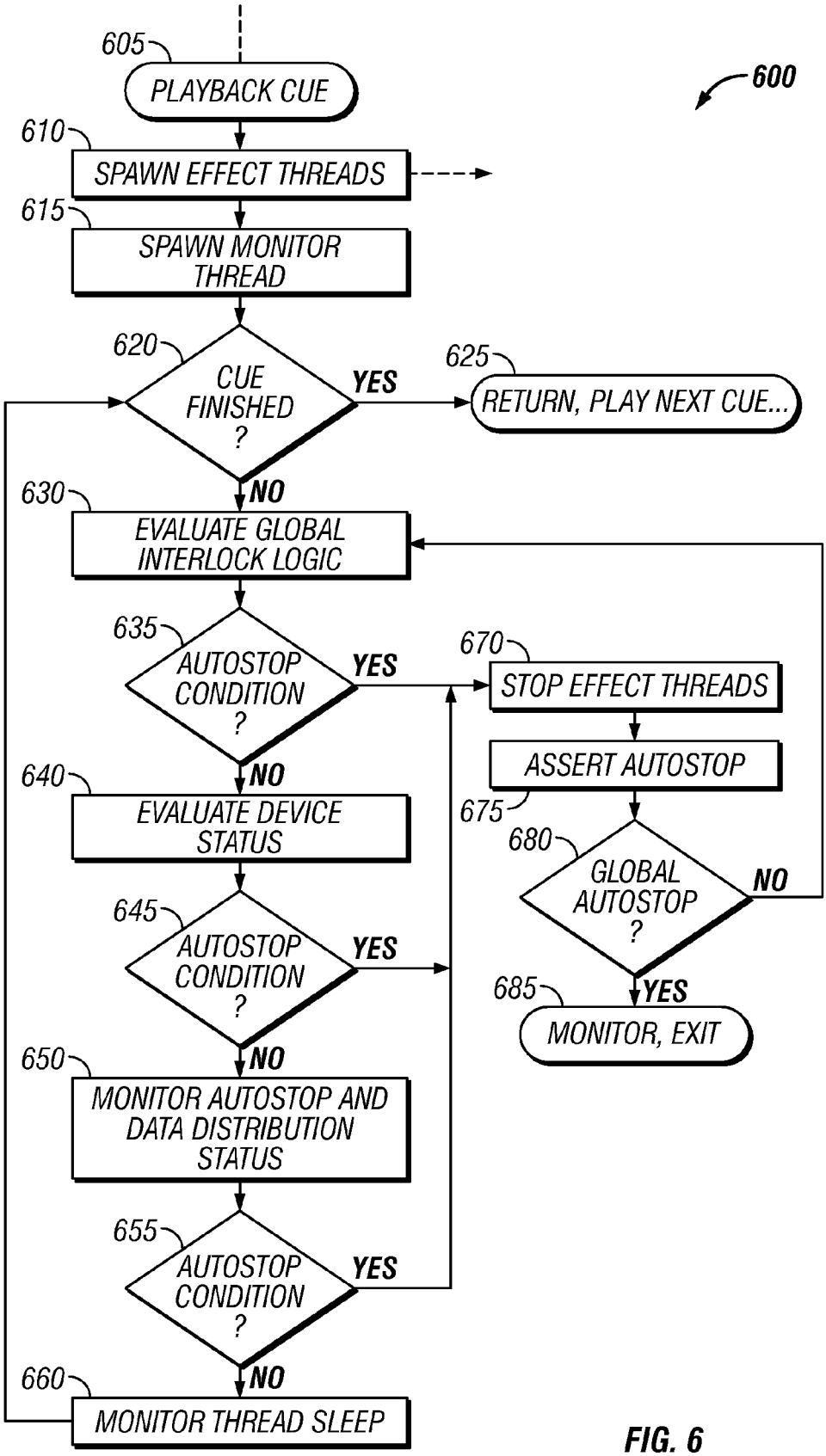
FIG. 6 is a flow diagram 600 illustrating the steps taken by the cue manager and other components of the show command system to play back a cue in one embodiment of the invention Like reference symbols in the various drawings indicate like elements.

FIG. 6 is a flow diagram 600 illustrating the operations carried out by the software of the show command system to play back a cue in one embodiment of the invention. At 605 the cue manager receives a command to play back a cue. At 610 separate threads are spawned for each effect profile in the cue. As discussed above, after the effect threads are spawned, each thread waits in a loop until its start condition evaluates to true. The cue manager may store the thread handle of each effect thread created at 610.

At 615 a monitor thread may be spawned. The monitor thread runs periodically to check the global interlock logic, evaluate device status, and monitor the autostop and data distribution component status to determine if an autostop signal should be asserted. The remainder of the flow diagram is executed within the monitor thread.

At 620 the monitor thread checks each effect thread to determine if the effect has completed. If no threads are running, the effects for the current cue have completed and the method can return at 625, otherwise the monitor thread continues at 630.

At 630 the global interlock logic associated with the running show profile is evaluated. As part of this evaluation, the monitor thread obtains the latest status information for each device and autostop and data distribution unit from the cue manager. If the evaluation of the global interlock logic indicates that no autostop is required 635, the flow continues at 640.

If the evaluation of the interlock logic 630 indicates that autostop is to be asserted 635, the flow continues at 670. At 670 the effect threads corresponding to the devices to be autostopped are terminated. This may be done in a variety ways depending upon the implementation technology.

At 675 the monitor thread running in conjunction with the cue manager may assert an autostop signal directed to the devices to be autostopped. This may involve throwing an exception or invoking an implementation technology specific Assertion class. The cue manager may also provide a method allowing the monitor thread to set an autostop variable such as Global.autostop=1, DeviceN.autostop=1, or the like. At 680, if the autostop is a device autostop, meaning that other effect devices may continue running, the flow may continue monitoring the system at 630. If the autostop is a global autostop 680, the monitor thread may exit at 685.

At 640 the status of each effect device is evaluated. This evaluation may include determining, based on the current position and velocity of the devices, whether they will be able to complete their effect. If the effect devices are in a position that their motion profile cannot be completed as defined in the cue, an autostop may be asserted because such failure would place the devices out of position for the next cue, creating a potentially dangerous situation. Similarly, failure of the devices to perform requested movements may be an indication of a fault in the device, creating a potentially dangerous situation. This information is evaluated at 645 to determine whether an autostop should be asserted. If the determining at 645 indicates autostop should be asserted, the flow continues at 670 as described above. If the determining at 645 indicates that autostop should not be asserted, the flow continues at 650.

At 650 the autostop and data distribution status is evaluated to determine whether an autostop should be asserted either for the autostop and data distribution unit as a whole, or for one or more devices contained within it. If the determination at 655 is to assert an autostop signal for the autostop and data distribution unit or an individual device, the flow continues at 670. Otherwise the flow continues at 660.

At 660 the monitor thread may sleep for some configurable period of time. Generally, the monitor thread should sleep for a period of time relating to the device update period. The device update period is the polling frequency at which the device management modules (555-560 in FIG. 5) obtain information from the autostop and data distribution unit. If the monitor thread sleep time is much less than the polling time, the method will run multiple times using the same set of device status data. Conversely, if the monitor thread sleeps to too long, important device updates may be missed allowing the system to get into and operate in a potentially dangerous state. The appropriate period may be different depending on the nature of the effect devices being used. After the monitor thread finishes sleeping at 660, the flow continues at 620 as described above.

Although certain operations of method 600 have been shown in a particular sequence, it would be appreciated by one skilled in the art that the evaluation of the global interlock logic, device status, and autostop and data distribution status, may be performed in any order or in parallel on separate threads. Furthermore, one skilled in the art would recognize that method 600 may be easily extended to monitor other aspects of the show control system not explicitly included in the above diagram.

Although only a few embodiments have been disclosed in detail above, other embodiments are possible and the inventor intends these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, an additional watchdog device may be used to monitor the execution of device controllers 230-232 in FIG. 2. The additional watchdog may be connected to an additional relay controlling the power connection to device 234-236. Furthermore the relays of FIG. 2 may electro-mechanical or solid state relay switches.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

The computers described herein may be any kind of computer, either general purpose, or some specific purpose computer such as a workstation. The computer may be a Pentium class computer, running Windows XP or Linux, or may be a Macintosh computer. The computer may also be a handheld computer, such as a PDA, cellphone, or laptop.

The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

What is claimed is:

1. A method, comprising:

receiving status information relating to a plurality of devices into a processing device; using programming in the processing device for first determining whether a first device of the plurality of devices should be stopped, wherein the determining includes evaluating a condition relating to the status of at least the first device of the plurality of devices;

said programming operating for automatically asserting an autostop signal that stops operation of the first device if the determining determines that said first device is malfunctioning by opening a first switch of a plurality of switches that are in series and are connected to supply power to said first device;

second determining using programming in the processing device whether the plurality of devices should be stopped, wherein the second determining includes evaluating a condition relating to the status of a control that controls the entire plurality of devices, and opening a second switch of said plurality of switches to interrupt said power to said first device, and opening other switches to interrupt power to others of said plurality of devices;

transmitting data to at least one of said devices indicative of an effect sequence to be carried out by said one of said devices only if said first determining and said second determining both determine that the one of the plurality of devices do not need to be stopped;

using the processing device for asserting an autostop signal directed to the plurality of devices if the second determining determines that the control that controls the entire plurality of devices is malfunctioning; and using a second auto stop signal, which is not created by any processing device, for controlling at least a third switch of said plurality of switches to interrupts said power to said first device, and opening other switches to interrupt power to others of said plurality of devices.

2. The method of claim 1, wherein the status information relates to one selected from the group consisting of a position of a device, a position of an object connected to a device, a velocity of a device, an acceleration of a device, a temperature of a device, power consumption of a device, a position of a relay connected to a power connection of a device, a state of a self-resetting fuse connected to a power connection of a device, a processing system connected to a device, and a watchdog device connected to a device.

3. The method of claim 1, wherein the first determining includes evaluating a condition relating to the effect sequence.

4. The method of claim 1, wherein the second determining includes evaluating a condition relating to the effect sequence.

* * * * *